United States Patent [19]

Klink

[11] Patent Number: 4,974,835

[45] Date of Patent: Dec. 4, 1990

[54] WEIGHT TRAINING DEVICE

[76] Inventor: Michael Klink, 123 Plaza Dr., Middletown, Conn. 06457

[21] Appl. No.: 438,307

[22] Filed: Nov. 16, 1989

[51] Int. Cl.[5] ..... A63B 21/06

[52] U.S. Cl. ..... 272/117; 272/123

[58] Field of Search ..... 272/117, 118, 123, 134, 272/144, DIG. 4

[56] References Cited

U.S. PATENT DOCUMENTS

| | | | |
|---|---|---|---|
| 3,268,224 | 8/1966 | Freshour | 272/117 |
| 4,231,569 | 11/1980 | Rae | 272/117 X |
| 4,249,726 | 2/1981 | Faust | 272/123 |
| 4,344,619 | 8/1982 | Szabo | 272/117 |
| 4,407,495 | 10/1983 | Wilson | 272/117 |
| 4,602,785 | 7/1986 | Rockwell | 272/123 |
| 4,700,944 | 10/1987 | Sterba et al. | 272/117 |

*Primary Examiner*—Robert Bahr

*Attorney, Agent, or Firm*—McCormick, Paulding & Huber

[57] ABSTRACT

A weight training device is provided wherein a weightlifter is afforded a full range of movement for each exercise without risk of injury. The device includes a beam having a first portion pivotally supported on a base and an opposite portion adapted to carry a plurality of barbell weights. The beam is moveable between a first position wherein the opposite portion of the beam assembly is supported on a first pair of weight support brackets and a second position, horizontally displaced from the first position, wherein the opposite portion of the beam assembly is supported on a second pair of brackets. A weightlifter adjusts the brackets to support the weights in fixed position relative to the base. If the weightlifter is unable to control the weight at any point during the exercise he may support the opposite portion of the beam on the brackets to avoid injury.

13 Claims, 3 Drawing Sheets

WEIGHT TRAINING DEVICE

BACKGROUND OF THE INVENTION

The present invention relates to exercise equipment and, more particularly, to a weight training device for safely performing a bench press exercise with free weights.

Weight training with barbells or dumbbells, commonly referred to as "free weights" by those who regularly engage in such activity, has retained its popularity despite the availability of a variety of progressive, multi-purpose weight training machines. Free weights are far less expensive than such machines, and many weight lifters believe that better results are achieved by exercising with free weights, particularly with regard to muscle mass and strength.

While exercising with free weights offers several advantages, it cannot be denied that this form of weight training can be dangerous when undertaken without proper training and supervision. When a person is lifting an amount of weight at the very limit of his present capabilities, the barbell can be difficult to balance which significantly increases the risk of injury. If the lifter attempts to lift a weight which is beyond his ability to handle or has performed repetitions to the point of total muscular failure, he will be forced to drop the barbell risking serious injury to himself or those around him.

The weight training exercise commonly referred to as the "bench press" has long been popular for strengthening the upper body, particularly the chest. However, as will be readily apparent following a description of this exercise, the bench press can be especially dangerous. In performing this exercise, a weight lifter lies face up on a flat bench with his feet on the floor. He extends his arms above his torso to grip and remove a barbell supported above his upper chest by a pair of stanchions attached to the bench. Once the lifter has steadied and balanced the barbell above his chest with his arms fully extended, he lowers the weight to his chest, pauses with the weight in that position for a brief moment and then returns the weight to a position where he is once again supporting the barbell with his arms fully extended. At this point he can perform one or more repetitions of the exercise, or return the barbell to the support stanchions.

A considerable amount of weight can be lifted in this exercise, and it is common for a person who has trained at this exercise for a few months to bench press a barbell equalling his body weight. Many weight lifters can bench press over 200 pounds with some performing presses of over 400 pounds.

To minimize the chance of serious injury, many weight lifters perform this exercise with a partner or "spotter" standing at the head of the bench ready to assist if the lifter can no longer support the barbell. However, many persons train alone either by choice or necessity, and the risk of incurring serious injury is greatly increased for such individuals. If a lifter training without a spotter loses control of the barbell and drops the weight on his torso, a crushing injury can result or, if the barbell falls on the trainee's neck, it can cause strangulation or obstruction of blood flow to the brain. Serious injury may also result in the situation where the trainee has lowered the weight to his chest and then becomes trapped under the barbell because he is unable to lift the barbell back to a position where he can return it to the support stanchions.

Attempts have been made to construct exercise devices on which the bench press can be performed at less risk to the lifter; however, in general, these devices are complex pieces of machinery which are expensive and inconvenient to use or interfere with the lifter's movement while he is performing the exercise. For example, U.S. Pat. No. 4,757,998 discloses a conventional weight training bench fitted with a safety device comprising two protective bars which lie over the torso of the lifter and are supported at a height just above chest level when the lifter is lying on the bench. If the lifter cannot support the weight, he simply lets it drop onto the support arms which prevent the weight from contacting and injuring the lifter.

While the device protects the lifter from injury, it prevents him from performing the exercise through his full range of motion. Lowering the barbell down onto the chest and supporting it there for a moment before returning it to the start position is the most important part of the bench press exercise from the standpoint of strength development. Since the safety bars are adjusted to a height just slightly above chest level, the lifter can never rest the bar across his chest. Even if the safety bars where adjusted to a height coinciding with the top of the lifter's chest, he could never support the barbell there by himself to gain the full benefit from the exercise because the barbell would contact and be supported at least in part by the safety bars.

Therefore, it is an object of the present invention to provide a weight training device useful for preforming weight training exercises without the need for an assistant or spotter.

It is a further object of the invention to provide such a weight training device which does not interfere with the lifter's full range of motion while performing bench pressing exercises.

It is a still further object of the invention to provide such a weight training device which is inexpensive to purchase and maintain.

SUMMARY OF THE INVENTION

The present invention meets these and other objects by providing a weight training device comprising a base, a weight carrying member for carrying a plurality of barbell plates and means associated with the base for supporting the weight carrying member for movement in both a vertical and horizontal direction with respect to the base. The weight training device further includes first and second weight support members mounted in fixed position above the base, with the second weight support member located between the base and the first weight support member. The weight carrying member is movable between a first position wherein engagement means mounted on the weight carrying member are vertically aligned and engagable with the first weight support member and a second position horizontally displaced from the first position wherein the engagement means are vertically aligned and engagable with the second weight support member.

DETAILED DESCRIPTION OF THE INVENTION

Figure 1:
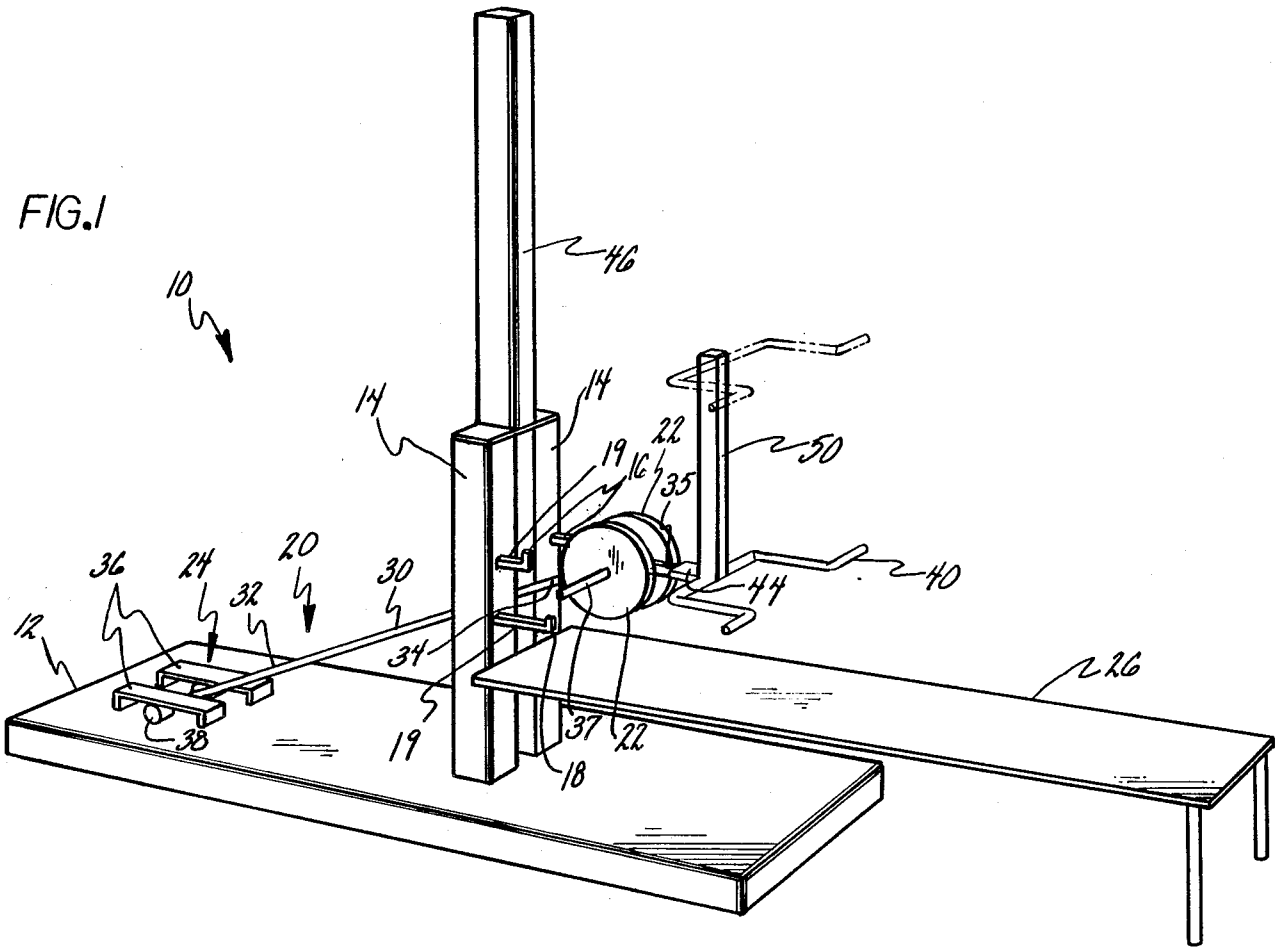
FIG. 1 is a perspective view of a weight training device embodying the present invention.

FIG. 1 illustrates a weight training device embodying the present invention. The device 10 generally comprises a base 12, two vertical, spaced apart stanchions 14,14 supported on the base 12, a first pair of weight support brackets 16,16 mounted on the stanchions and a second pair of weight support brackets 18,18 mounted on the stanchions between the base and the first pair of brackets. The weight training device 10 further includes a beam assembly, generally indicated at 20, for carrying a plurality of barbell plates 22,22, and a horizontally movable fulcrum, indicated generally at 24, associated with the base 12 for pivotally supporting the beam assembly 20 for movement in both a horizontal and vertical direction with respect to the base. A bench 26 is detachably connected to the device 10 for supporting a weight lifter while he performs various weight training exercises with the device.

The base 12 is preferably made of metal and is of sufficient dimension and weight to stabilize the device 10 during operation. The base may further serve as a platform for the lifter while performing certain exercises with the device such as, for example, dead lifts, seated shoulder presses, standing shoulder presses and squats.

The vertical stanchions 14,14 are mounted on the base in fixed position and are spaced far enough apart to allow the bean assembly 20 to move freely between them. The stanchions are formed with a plurality of vertically spaced holes 28,28 for receiving the first and second pairs of weight support brackets. Both pairs of brackets take the form of substantially L-shaped pins, each pin having a portion 19 receivable within the vertically spaced holes formed in the stanchions. It is important to note, that the second pair of brackets 18,18 extends farther out from the stanchions than the first pair of brackets 16,16. The importance of this feature will be explained in more detail below in connection with a description of the operation of the device.

Figure 3:
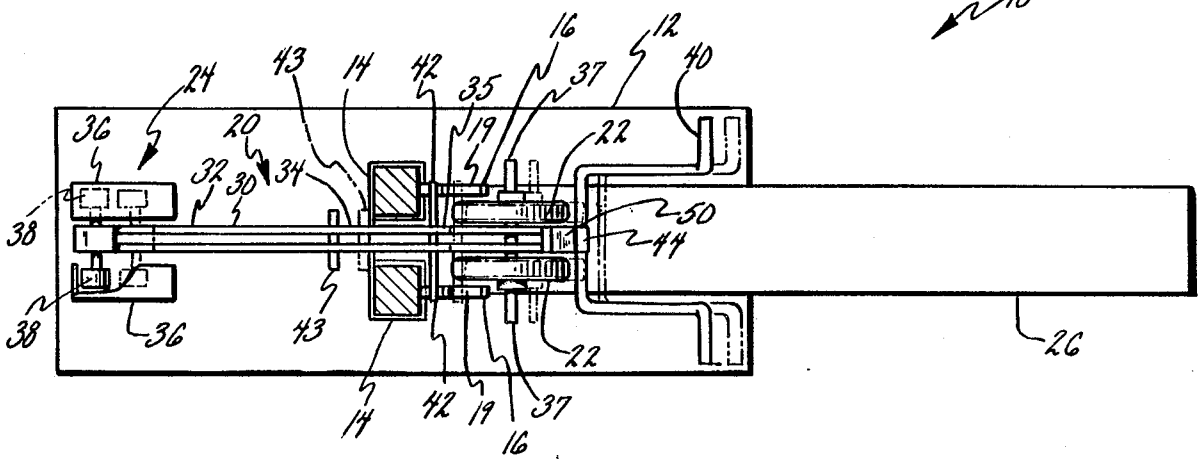
FIG. 3 is a sectional view of the device shown in FIG. 1 taken along the line 3—3.

The beam assembly 20 comprises an elongated beam 30 having a first portion 32 pivotally supported on the base 12 by fulcrum 24 and an opposite portion 34. The opposite portion 34 of the shaft 30 defines a receiver portion 35 having a pair of weight carrying pins 37,37 (shown best in FIG. 3) for receiving and carrying the barbell plates 22,22. To permit a weightlifter to firmly grip and move the beam assembly 20, a handlebar 40 is releasably attached to the receiver portion 35 of the beam 30. The opposite portion 34 of the beam further includes a pair of beam engagement pins 42,42 (shown best in FIG. 3) engagable with the first and second pairs of weight support brackets to support the opposite end of the beam assembly in fixed position relative to the base 12.

As stated previously, the horizontally movable fulcrum 24 permits the beam assembly 20 to move in both a horizontal and vertical direction with respect to the base 12. The fulcrum 24 comprises a pair of roller housings 36,36 mounted on the base 12 and a pair of rollers 38,38 pivotally connected to the first portion 32 of the beam 30. Each one of the pair of rollers is slidably maintained in one of the roller housings.

Figure 2:
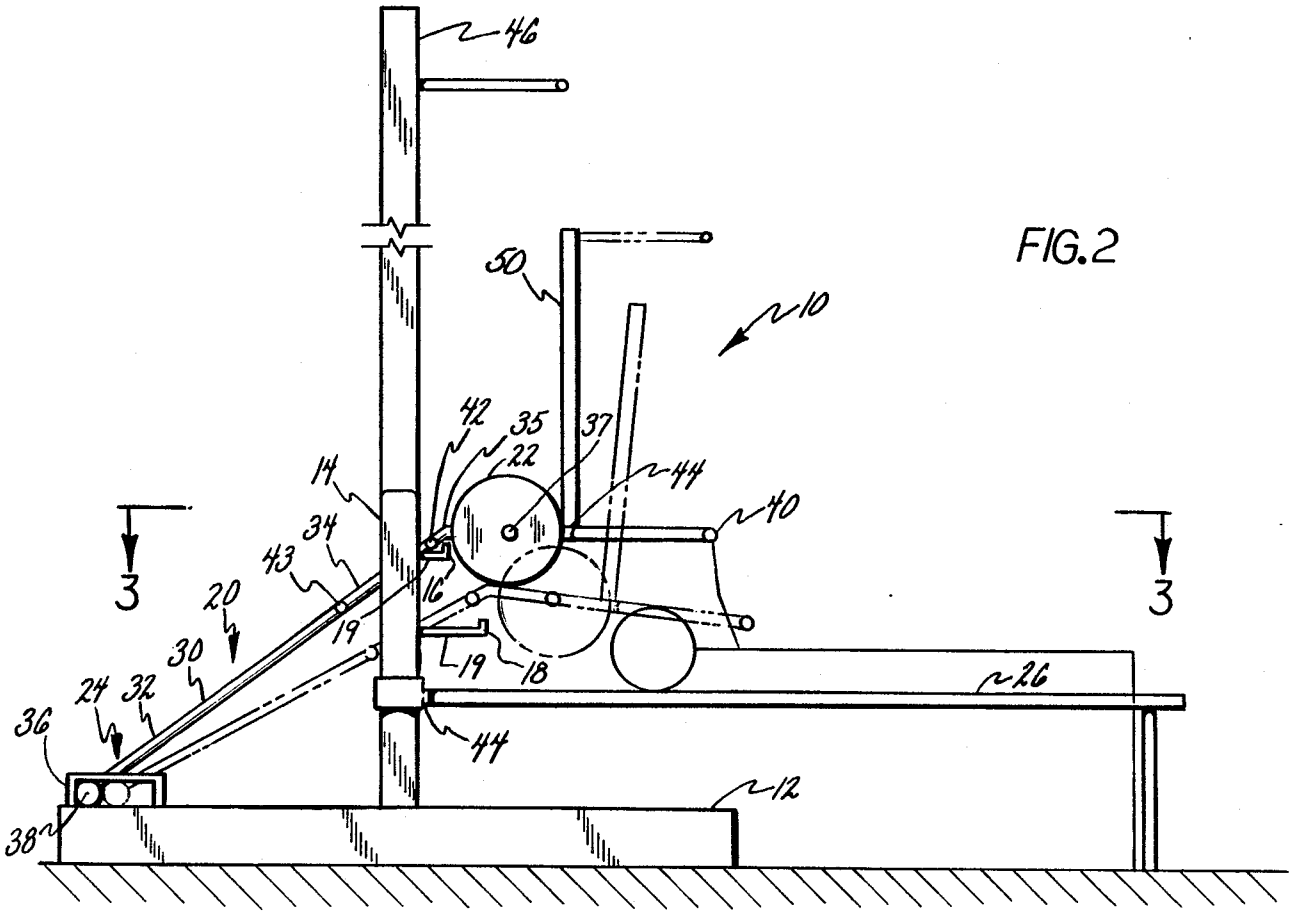
FIG. 2 is a side elevational view of the weight training device shown in FIG. 1.

Referring now to FIG. 2, a weightlifter gripping the handlebar and supporting the opposite portion 34 of the beam 30 can pivot the beam assembly 20 vertically and slide it horizontally with respect to the base by means of fulcrum 24. The beam assembly can be moved between a first position (shown in full line in FIG. 2) wherein the beam engagement pins 42,42 are vertically aligned and engagable with the first pair of weight support brackets 16,16 and a second position (shown in phantom in FIG. 2) wherein the beam engagement pins are vertically aligned and engagable with the second pair of weight support brackets 18,18. The second position is horizontally displaced from the first position, and a pair of stop pins 43,43 located on the beam 30 prevent the beam assembly 20 from being moved horizontally beyond the second position. The stop pins are located on the beam so that the pins butt against the stanchions 14,14 when the beam assembly is moved to the second position.

Still referring to FIG. 2, the operation of the device 10 will be explained in connection with the performance of a bench press exercise. When performing a bench press exercise, the weightlifter begins by attaching the bench 26 to the stanchions by means of releasable couplings 44,44 (one shown) at a height which permits the lifter to place his feet flat on the floor when lying face up on the bench.

The opposite portion 34 of the beam assembly 20 is then supported on the first pair of weight support brackets 16,16 at a height above the base that allows the lifter to almost fully extend his arms and grip the handlebar 40 when he is lying on the bench with his chest positioned below the handlebar. This is accomplished by inserting the first pair of weight support brackets 16,16 into vertically spaced holes located on the stanchions at the proper height and then gripping the handlebar 40 to move the beam assembly 20 vertically and horizontally with respect to the base to the position where the beam engagement pins 42,42 engage and rest on the first pair of weight support brackets.

The second pair of weight support brackets 18,18 are then inserted into vertical holes on the stanchions to support the opposite end 34 of the beam assembly at a height above the base which permits the handlebar 40 to extend just below the lifter's chest level when he is lying in position on the bench. With the second pair of brackets positioned on the stanchions in this manner, the weightlifter can lower the handlebar to chest level without having the opposite end of the beam assembly contact either pair of support brackets. Thus, the weightlifter alone supports the weight through the full range of motion required to obtain maximum benefit from the exercise.

Once the weightlifter has the support brackets properly located on the stanchions and the opposite end of the beam assembly supported on the first pair of brackets, he is ready to perform the bench press exercise. He begins by lying back on the bench with his chest positioned beneath the handlebar. He grasps the handlebar, lifts the opposite portion of the beam assembly off the first pair of support brackets and moves the beam assembly toward the foot end of the bench far enough so that the beam engagement pins will clear the tips of the brackets 16,16 as he lowers the handlebar to chest level.

If the weightlifter has not chosen a weight which exceeds his present capabilities, he lowers the handlebar to chest level, supports the weight in that position for a brief moment and then returns the weight to a position where he can slide the beam assembly back toward the stanchions and lower the assembly so that the engagement pins engage the first pair of support brackets.

If the lifter has selected a weight beyond his capabilities and finds he cannot control the weight at any point during the exercise after he has lifted the opposite portion of the beam assembly off of the first pair of brackets and moved it forward so that the beam engagement pins clear the tips of the brackets, he can simply let go of the handlebar and drop the opposite portion of the beam 30 onto the second pair of support brackets 18,18 without any risk of injury. It will be readily apparent that this is the case since the second pair of brackets extends farther out from the stanchions than the first pair of brackets and the stop pins prevent the lifter from pulling the beam assembly toward the foot end of the bench to a point where the beam engagement pins will not be in vertical alignment with the second pair of brackets.

While the operation of the device 10 and its advantages have been described primarily in connection with the performance of a bench press exercise, the present invention is useful for a number of other exercises wherein the lifter is afforded a full range of movement without risk of injury.

The opposite portion of the beam 30 is adapted to releasable support a vertical post 50. The handlebar 40 is removed from the end of the beam and releasably coupled by coupling 44 to the post 50 anywhere along its length. Those individuals actively engaged in weight training will recognize that by properly selecting the height from the base at which the handlebar is coupled to the post 50 and further selecting the proper height above the base at which the opposite of the beam is supported, device 10 may be used to perform weight training exercises such as those noted above.

In addition, the device 10 may be used for other forms of exercise. As shown in FIGS. 1 and 2, the handlebar 40 may be removed from the opposite portion 34 of the beam 30 and releasably coupled by means of coupling 44 to a vertical post 46 supported by the stanchions 14,14. With the handlebar in this position an individual can perform, for example, pull-ups or chin-ups. Further, the bench 26 can by releasably coupled to the vertical post 46 to provide, for example, an inclined support surface for sit-ups.

While the invention has been described above with reference to a particular embodiment, it will be understood that the above description is illustrative and not intended to be limiting and that usage of the device for activities other than those specifically disclosed above are within the scope of the invention.

I claim:

1. A weight training device comprising:

a base;

a beam assembly having a receiver portion for carrying a plurality of weights;

first and second weight support members mounted in fixed position above said base, said second weight support member located between the base and said first weight support member;

engagement means mounted on said beam assembly and engagable with said first and second weight support members for supporting said beam assembly in spaced relationship from said base, and means associated with said base for supporting said beam assembly for movement in both a vertical and horizontal direction with respect to said base between a first position wherein said engagement means are vertically aligned and engagable with said first weight support member and a second position horizontally displaced from said first position wherein said engagement means are vertically aligned and engagable with said second weight support member.

2. The weight training device of claim 1 wherein said means associated with said base for supporting said beam assembly comprises means horizontally spaced from said first and second weight support members for pivotally supporting said beam assembly between said first and said second positions.

3. The weight training device of claim 1 wherein said means associated with said base for supporting said beam assembly comprises means defining a horizontally moveable fulcrum horizontally spaced from said first and second weight support members for pivotally supporting said beam assembly between said first and said second positions.

4. The weight training device of claim 3 wherein said beam assembly comprises a first portion pivotally connected to said horizontally moveable fulcrum and an opposite portion defining said receiver portion and adapted to carry a plurality of weights.

5. The weight training device of claim 1 further comprising at least one vertical stanchion supported on said base for mounting said first and second weight support members in fixed position above said base.

6. The weight training device of claim 5 further comprising limiting means for limiting the movement of said beam assembly horizontally with respect to said base.

7. The weight training device of claim 1 further comprising a bench having a support surface for supporting a weight lifter in spaced relationship from said base.

8. The weight training device of claim 3 wherein said horizontally movable fulcrum comprises a roller housing mounted on said base and at least one roller pivotally connected to said first portion of said beam assembly, said roller slidably maintained in said roller housing for movement in a horizontal direction with respect to said base.

9. The weight training device of claim 5 further characterized in that said first and second weight support members comprise substantially L-shaped brackets, said stanchion formed with a plurality of vertically spaced holes, said L-shaped brackets having portions for insertion into said holes in a plurality of fixed positions above said base.

10. The weight training device of claim 4 further characterized in that said engagement means comprises beam engagement pins mounted on said beam assembly and engagable with said first and second weight support members.

11. The weight training device of claim 6 further characterized in that said limiting means comprises stop means mounted on said beam assembly and engagable with said vertical stanchion.

12. The weight training device of claim 4 further characterized in that said receiver portion of said beam assembly comprises at least one weight holding pin mounted on said beam assembly for holding a plurality of weights, said beam assembly also including a handlebar gripable by said weight lifter for moving said support beam assembly in both a vertical and horizontal direction with respect to said base.

13. A weight training device comprising:

a base;

a pair of spaced apart vertical stanchions supported on said base, said stanchions having a plurality of vertically spaced holes formed therein;

a beam assembly for carrying a plurality of weights pivotally mounted on said base for movement in both a vertical and horizontal direction with respect to said base, said beam assembly provided in the space between said stanchions, said beam assembly having a first portion and an opposite portion, said opposite portion defining a receiver portion for carrying a plurality of weights;

a pair of weight carrying pins mounted on said receiver portion of said beam assembly for holding a plurality of weights;

a first pair of substantially L-shaped weight support brackets receivable within said vertically spaced holes;

a second pair of substantially L-shaped weight support brackets receivable within said vertically spaced holes, said second pair of brackets located between said base and said first pair of brackets;

a pair of beam engagement pins mounted on said opposite portion of said beam assembly and engagable with said first pair of weight support brackets for supporting said opposite portion of said beam assembly in a first fixed position relative to said base, said pair of engagement pins also engagable with said second pair of weight support brackets for supporting said opposite portion of said beam assembly in a second fixed position relative to said base;

a horizontally moveable fulcrum associated with said base for pivotally supporting said beam assembly for movement in both a horizontal and vertical direction with respect to said base between a first position wherein said beam engagement pins are vertically aligned and engagable with said first pair of weight support brackets and a second position horizontally displaced from said first position wherein said beam engagement pins are vertically aligned and engagable with said second pair of weight support pins, said horizontally moveable fulcrum comprising a pair of roller housings mounted on said base horizontally spaced from said vertical stanchions and a pair of rollers pivotally connected to said first portion of said beam assembly, each one of said pair of rollers slidably maintained in one of said pair of roller housings;

a pair of stop pins mounted on said beam assembly and engagable with said vertical stanchions for limiting the movement of said beam assembly horizontally with respect to said base;

a handlebar releasably attached to said opposite portion of said beam assembly, said handlebar grippable by a weightlifter for moving said beam assembly in both a vertical and horizontal direction with respect to said base;

a vertical post supported by and extending above said vertical stanchions for releasably supporting said handlebar, and a bench detachably connected to said device, said bench having a support surface for supporting a weightlifter in spaced relationship from said base.

* * * * *